United States Patent [19]

Nakamura et al.

[11] 4,390,003

[45] Jun. 28, 1983

[54] PETROLEUM COMBUSTION DEVICE

[75] Inventors: Kazuharu Nakamura, Nagoya; Yoshio Mito, Gifu; Yutaka Nakanishi, Konan; Toshihiko Yamada, Toyoake, all of Japan

[73] Assignee: Toyotomi Kogyo Co., Ltd., Nagoya, Japan

[21] Appl. No.: 265,068

[22] Filed: May 19, 1981

[30] Foreign Application Priority Data

Jun. 11, 1980 [JP] Japan ..... 55-82168[U]
Jun. 11, 1980 [JP] Japan ..... 55-82169[U]

[51] Int. Cl.[3] ..... F24C 5/04

[52] U.S. Cl. ..... 126/96; 431/201; 431/309

[58] Field of Search ..... 126/96; 431/195, 201, 431/309, 311

[56] References Cited

U.S. PATENT DOCUMENTS

| | | | |
|---|---|---|---|
| 545,401 | 8/1895 | Atwood et al. | 126/96 |
| 569,795 | 10/1896 | Morss | 431/309 |
| 3,168,132 | 2/1965 | Axelsson | 431/195 |

*Primary Examiner*—Carroll B. Dority
*Attorney, Agent, or Firm*—Stern & Roberts

[57] ABSTRACT

A petroleum combustion device for heating rooms or the like comprising a primary combustion chamber, a secondary combustion chamber disposed on the primary combustion chamber and provided at that portion of its base plate which is outside an outer cylinder of the primary combustion chamber with an air path and a flame extension device arranged in the secondary combustion chamber and communicated with the upper portion of an inner flame cylinder of the primary combustion chamber.

5 Claims, 5 Drawing Figures

PETROLEUM COMBUSTION DEVICE

BACKGROUND OF THE INVENTION

1. Field of the Invention

This invention relates to a petroleum combustion device for heating rooms or the like.

2. Description of the Prior Art

Petroleum combustion devices tend to generate soot or smoke due to want of air. Atempts have been made to eliminate such drawback which has been encountered with the prior art techniques, but none was led to satisfactory results.

SUMMARY OF THE INVENTION

An object of the invention, therefore, is to provide a petroleum combustion device which is provided with a double cylinder type combustion cylinder, which can supply fresh air in multi-stage manner so as to effect a complete combustion, and which is high in combustion efficiency.

A feature of the invention is the provision of a petroleum combustion device comprising a primary combustion chamber composed of a combustion cylinder including an inner flame cylinder, outer flame cylinder and an outer cylinder; a secondary combustion chamber disposed on said primary combustion chamber and provided at that portion of its base plate which is outside said outer cylinder of said primary combustion chamber with an air path, said secondary combustion chamber including an upper flame cylinder located above said air path; and a flame extension device arranged in said secondary combustion chamber and communicated with the upper portion of said inner flame cylinder of said primary combustion chamber; said outer cylinder of said primary combustion chamber being formed by a transparent or translucent heat resistant heat ray transmission substance.

Further objects and features of the invention will be fully understood from the following detailed description with reference to the accompanying drawings, wherein:

DETAILED DESCRIPTION OF THE PREFERRED EMBODIMENTS

Figure 1:
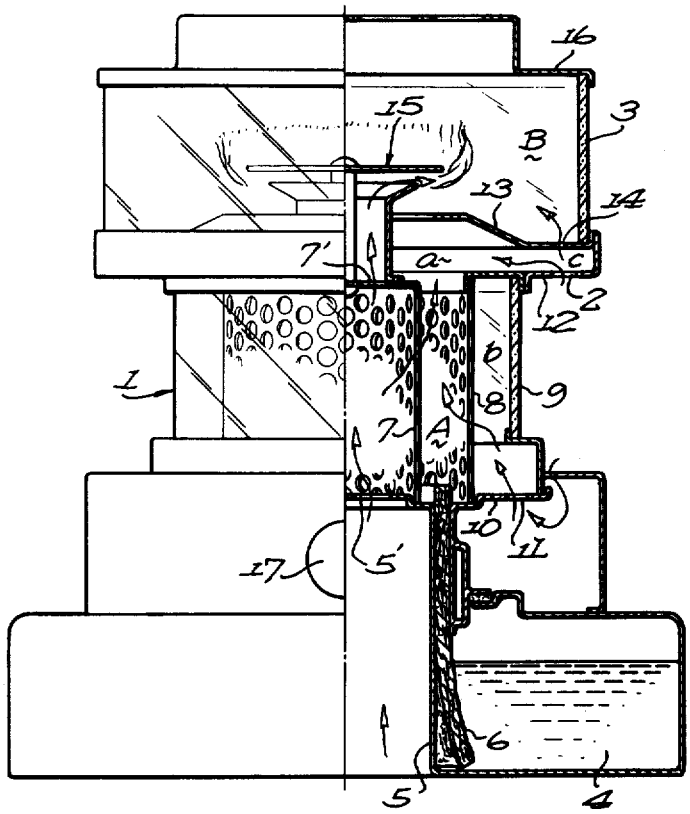
FIG. 1 is a front elevational view of one embodiment of a petroleum combustion device according to the invention, partly shown in section.

FIG. 1 shows one embodiment of a petroleum combustion device according to the invention and comprises a primary combustion chamber A including a double cylinder type combustion cylinder 1, a secondary combustion chamber B disposed on the primary combustion chamber A and including an upper flame cylinder 3 and air paths 2, 11 communicating both the primary and secondary combustion chambers A, B with the outside of the combustion cylinders thereof.

In FIG. 1, reference numeral 4 designates an oil tank which is provided at its center portion with a center cylinder 5. The center cylinder 5 is provided at its outside with a combustion wick 6. Reference numeral 7 designates an inner flame cylinder; 8 an outer flame cylinder arranged concentrically with its inner flame cylinder 7 with the primary combustion chamber A interposed therebetween; 9 an outer cylinder surrounding the outer flame cylinder 8 and spaced apart therefrom by a gap b; 10 a combustion cylinder support member connected to the oil tank 4 and supporting the combustion cylinder 1; 11 an air path formed in the combustion cylinder support member 10 and introducing air from the outside into the gap b.

Figure 2:
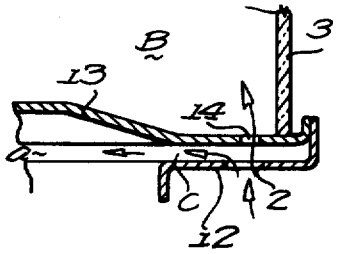
FIG. 2 is an enlarged cross-sectional view of an upper flame path of a primary combustion chamber.
Figure 4:
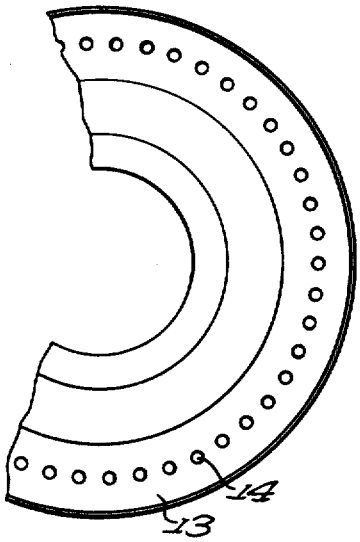
FIG. 4 is an enlarged plan view of a base plate of a secondary combustion chamber.
Figure 5:
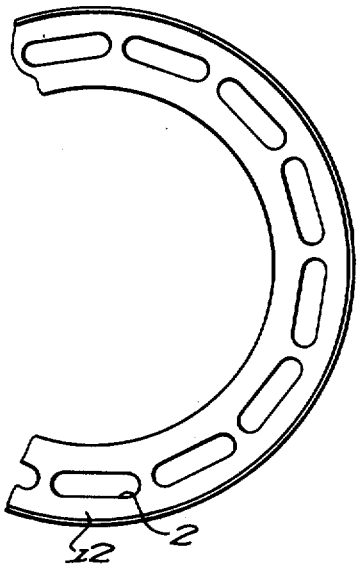
FIG. 5 is an enlarged plan view of a guide plate.

Provision is made of a guide plate 12 for guiding air from the outside of the combustion cylinder into an upper flame path a arranged above the primary combustion chamber A. Above the guide plate 12 is arranged a base plate 13 of the secondary combustion chamber B with a gap c formed therebetween. The guide plate 12 and the base plate 13 are provided with a plurality of air paths 2 and 14, respectively. The rate of opening of the air paths 2 provided in the guide plate 12 is made larger than that of the air paths 14 provided in the base plate 13 as clearly shown in FIGS. 2, 4 and 5.

Figure 3:
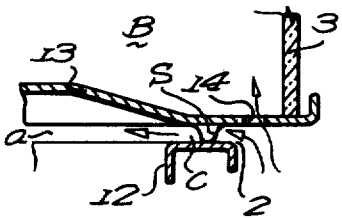
FIG. 3 is an enlarged cross-sectional view of another embodiment of an upper flame path of a primary combustion chamber.

In the embodiment shown in FIG. 3, the guide plate 12 is spaced apart from the base plate 13 by means of a spacer S and the air path 2 is formed by the gap c between the guide plate 12 and the base plate 13.

A flame extension device 15 is arranged in the secondary combustion chamber B and connected to the upper portion of the inner flame cylinder 7. Reference numeral 16 designates an upper cover for closing the upper surface of the upper flame cylinder 3. The inner and outer cylinders 7, 8 are provided with a number of air holes, respectively. It is a matter of course that the center cylinder 5 is provided at its upper surface with an air path 5', while the inner flame cylinder 7 is provided at its upper surface with an air path 7'. Reference numeral 17 designates a wick raising and lowering knob.

The petroleum combustion device constructed as above described according to the invention will operate as follows. In the first place, the oil tank 4 is supplied with oil and then the knob 17 is rotated so as to project the combustion wick 6 above the center cylinder 5. The combustion wick 6 is then ignited with the aid of a match or the like. An amount of air necessary for combustion is supplied through the air holes in the inner and outer flame cylinders 7, 8 into the primary combustion chamber A to effect combustion therein. A part of the un-combustion gas is raised in the primary combustion chamber A and arrives at an upper flame path a.

Meanwhile, the secondary air is supplied from the air paths 2 into the upper flame path a to contribute to complete combustion. The primary combustion chamber A is provided at its upper portion with the secondary combustion chamber B including the upper flame cylinder B. As a result, a portion of the fresh air is supplied through the air paths 2 into the secondary combustion chamber B and the air is supplied from the air path 7' through the flame extension device 15 connected to the upper part of the inner flame cylinder 7 to the secondary combustion chamber B so as to complete a final combustion. In this kind of combustion system, the inner and outer flame cylinders 7, 8 are red heated, so that it is preferable that the outer cylinder 9 is formed by a heat ray transmission substance. It is ideal to effect white ray flame combustion in the secondary combustion chamber B. As a result, it is preferable that the upper flame cylinder 3 is formed by heat ray and light ray transmission substance.

As stated hereinbefore, the petroleum combustion device according to the invention makes use of a multi-stage combustion in the primary and secondary combustion chambers so that a much amount of fuel can be perfectly burnt so as to make waste gas extremely small.

In addition, the air path is divided into two portions and one portion of air is introduced into the secondary combustion chamber, and as a result, it is possible to eliminate the drawback that tends to generate soot or smoke due to want of air which has been encountered with the prior art techniques. That is, combustion is perfectly effected again in the secondary combustion chamber so as to prevent generation of soot or smoke.

Moreover, air is directly supplied to the secondary combustion chamber B, so that the supply air is accelerated by the convection speed and raised up in parallel with the inner surface of the upper flame cylinder 3 to increase the amount of air to be introduced into the center part of the upper flame cylinder 3 and hence there is no risk of the front end of the flame being made contact with the inner surface of the upper flame cylinder 3, thereby preventing generation of smoke or soot near the upper flame cylinder 3. In addition, the rate of opening of the air paths 2 provided in the guide plate 12 for effectively supplying the combustion air from the outside of the combustion cylinder into the upper flame path is made large, so that much amount of air is supplied through the gap c to the upper flame path a, thereby contributing to the completion of the secondary combustion. Moreover, the base plate 13 opposed to the guide plate 12 is provided with the air paths 14 so as to supply a small amount of fresh air into the secondary combustion chamber B. As a result, it is possible to effect complete combustion and make the waste gas extremely clean.

What is claimed is:

1. A petroleum combustion device comprising a primary combustion chamber composed of a combustion cylinder including an inner flame cylinder, outer flame cylinder and an outer cylinder; a secondary combustion chamber having a base plate and disposed on said primary combustion chamber and provided at that portion of its base plate which is outside said outer cylinder of said primary combustion chamber with means forming an air path, said secondary combustion chamber including an upper flame cylinder located above said air path; and a flame extension device arranged in said secondary combustion chamber and communicated with the upper portion of said inner flame cylinder of said primary combustion chamber; said outer cylinder of said primary combustion chamber being formed by a transparent or translucent heat resistant heat ray tranmission substance.

2. The petroleum combustion device according to claim 1, wherein said upper flame cylinder of said secondary combustion chamber is formed by a transparent or translucent heat resistant heat ray transmission substance.

3. The petroleum combustion device according to claim 1, wherein said means forming said air path includes means for communicating the outside of the combustion cylinder to the primary and secondary combustion chambers.

4. The petroleum combustion device according to claim 3, wherein the means comprising the cross-sectioned area of said air path to the primary combustion chamber is made larger than the means comprising the cross-sectional area of said secondary combustion chamber.

5. The petroleum combustion device according to claim 1, wherein said air path to the secondary combustion chamber is arranged near the inner periphery of said upper flame cylinder of said second combustion chamber.

* * * * *